US011706550B2

(12) United States Patent
Jiang et al.

(10) Patent No.: US 11,706,550 B2
(45) Date of Patent: Jul. 18, 2023

(54) TERMINAL DEVICE

(71) Applicant: VIVO MOBILE COMMUNICATION CO., LTD., Guangdong (CN)

(72) Inventors: Guozhu Jiang, Guangdong (CN); Lifeng Long, Guangdong (CN)

(73) Assignee: VIVO MOBILE COMMUNICATION CO., LTD, Guangdong (CN)

( * ) Notice: Subject to any disclaimer, the term of this patent is extended or adjusted under 35 U.S.C. 154(b) by 78 days.

(21) Appl. No.: 17/569,173

(22) Filed: Jan. 5, 2022

(65) Prior Publication Data

US 2022/0132232 A1 Apr. 28, 2022

Related U.S. Application Data

(63) Continuation-in-part of application No. PCT/CN2020/100171, filed on Jul. 3, 2020.

(30) Foreign Application Priority Data

Jul. 8, 2019 (CN) ..... 201910610787.6

(51) Int. Cl.
*H04R 1/08* (2006.01)
*H04R 1/04* (2006.01)

(52) U.S. Cl.
CPC ..... *H04R 1/083* (2013.01); *H04R 1/04* (2013.01)

(58) Field of Classification Search
CPC ..... H04R 1/083; H04R 1/04; H04R 1/2884; H04R 1/2846; H04R 2499/11; H04R 1/08; G06F 1/1633; G10K 11/16
See application file for complete search history.

(56) References Cited

U.S. PATENT DOCUMENTS 10,148,800 B1 * 12/2018 Frederickson ..... H04M 1/035
2012/0288130 A1 11/2012 Dehe
2016/0241953 A1 * 8/2016 Elian ..... H04R 1/406
2016/0286293 A1 9/2016 Akino
(Continued)

FOREIGN PATENT DOCUMENTS

CN 102480538 A 5/2012
CN 202889436 U 4/2013
CN 206629228 U 11/2017
(Continued)

OTHER PUBLICATIONS

Extended European Search Report for European Patent Application No. 20837052.8 issued by the European Patent Office dated Aug. 8, 2022.

(Continued)

*Primary Examiner* — Tuan D Nguyen
(74) *Attorney, Agent, or Firm* — IP & T Group LLP

(57) ABSTRACT

A terminal device includes a housing, a microphone, a sound guide support, a circuit board, and a vibration assembly. The housing is provided with a sound collecting hole, the sound guide support and the circuit board are disposed in the housing, the sound guide support and the circuit board form a first cavity, the vibration assembly is disposed between the sound guide support and the circuit board and separates the first cavity into a sound guide channel and a second cavity, and the microphone and the sound collecting hole are respectively disposed at both ends of the sound guide channel.

11 Claims, 2 Drawing Sheets

(56) References Cited

U.S. PATENT DOCUMENTS

| | | | | |
|---|---|---|---|---|
| 2017/0111721 | A1 | 4/2017 | Miehl et al. | |
| 2017/0251291 | A1* | 8/2017 | Nakamura | H04R 1/083 |

FOREIGN PATENT DOCUMENTS

| | | | |
|---|---|---|---|
| CN | 207266244 | U | 4/2018 |
| CN | 108293159 | A | 7/2018 |
| CN | 108513241 | A | 9/2018 |
| CN | 110428799 | A | 11/2019 |
| EP | 2552127 | A1 | 1/2013 |

OTHER PUBLICATIONS

International Search Report and Written Opinion of International Application No. PCT/CN2020/100171 dated Sep. 17, 2020.
First Office Action of Priority Application No. 201910610787.6 dated Jun. 23, 2020.

* cited by examiner

TERMINAL DEVICE

CROSS-REFERENCE TO RELATED APPLICATIONS

This application is a Bypass Continuation-in-Part Application of PCT/CN2020/100171 filed on Jul. 3, 2020, which claims priority to Chinese Patent Application No. 201910610787.6 filed on Jul. 8, 2019, which are incorporated herein by reference in their entirety.

TECHNICAL FIELD

The present disclosure relates to the field of communications device technologies, and in particular, to a terminal device.

BACKGROUND

With the advancement of fifth-generation (5G) technologies, terminal devices have put forward higher requirements on radio frequency and antenna layout environments. As an antenna clearance increases, correspondingly increased antenna springs occupy an area, in which a microphone is originally installed, at a bottom edge of a motherboard. This causes a position of the microphone to be moved inward, and consequently, the microphone needs to pass through a longer sound guide channel to connect to a sound collecting hole on a device housing. A length of the sound guide channel determines a resonance frequency of the microphone, and an increased length of the sound guide channel causes the microphone to form a relatively sharp resonance peak near the resonance frequency. After the microphone picks up sound, it usually enters a digital-to-analog converter (ADC) for encoding after gain amplification. When the resonance frequency is within a narrowband/broadband operating frequency range of the terminal device, sensitivity near the resonant peak of the microphone exceeds a threshold of the ADC and amplitude limiting is caused, which eventually causes severe recording distortion.

Usually, a dust-proof net with a large acoustic resistance or a plurality of dust-proof nets are selected to reduce the resonance peak, but have a limited effect, and a dust-proof net with a large acoustic resistance increases a risk of hole blocking.

SUMMARY

A terminal device is provided, including a housing, a microphone, a sound guide support, a circuit board, and a vibration assembly. The housing is provided with a sound collecting hole, the sound guide support and the circuit board are disposed in the housing, the sound guide support and the circuit board form a first cavity, the vibration assembly is disposed between the sound guide support and the circuit board and separates the first cavity into a sound guide channel and a second cavity, and the microphone and the sound collecting hole are respectively disposed at both ends of the sound guide channel.

Optionally, in the foregoing terminal device, the sound guide support is provided with a sound guide groove, the circuit board covers a notch of the sound guide groove, the circuit board and the sound guide groove are connected to form the first cavity, the circuit board is provided with a connecting hole, and the microphone is disposed on a side, away from the sound guide support, of the circuit board, and communicates with the sound guide channel through the connecting hole.

Optionally, in the foregoing terminal device, the sound guide support further includes a mounting groove, the mounting groove intersects the sound guide groove, the vibration assembly includes a mounting bracket and a vibration plate, the mounting bracket is disposed in the mounting groove, a portion of the mounting bracket extends into the sound guide groove through the notch of the sound guide groove, the portion of the mounting bracket extending into the sound guide groove is provided with a mounting hole, the mounting hole communicates with the sound guide groove, the vibration plate blocks the mounting hole, and the vibration plate, the mounting bracket, and the circuit board seal the notch of the sound guide groove, and together with the sound guide groove, form the sound guide channel.

Optionally, in the foregoing terminal device, the mounting bracket is a groove-shaped structural member, the groove-shaped structural member is mounted in the mounting groove, the mounting groove penetrates to edges of the sound guide support, both ends of the mounting groove are open ends, the groove-shaped structural member is disposed between the circuit board and the sound guide support, and an area, opposite to the sound guide groove, in the groove-shaped structural member is provided with the mounting hole.

Optionally, in the foregoing terminal device, the mounting bracket is fixed in the mounting groove in a snap-fit manner.

Optionally, in the foregoing terminal device, the vibration plate is fixed in a lap joint manner on an edge of the mounting hole.

Optionally, in the foregoing terminal device, a sealing member is disposed between the vibration plate and the edge of the mounting hole.

Optionally, in the foregoing terminal device, the sealing member includes a sealing tape and foam, and the vibration plate blocks the mounting hole through the sealing tape and the foam.

Optionally, in the foregoing terminal device, an area of the vibration plate is smaller than an area of the mounting hole, the vibration plate is covered with a sound film, the vibration plate is fixed on the mounting bracket through the sound film, and an entirety formed by the vibration plate and the sound film blocks the mounting hole.

Optionally, in the foregoing terminal device, the housing includes a middle frame, and the sound collecting hole is disposed in the middle frame.

Optionally, in the foregoing terminal device, a sound absorbing structural member is disposed in the sound guide channel.

BRIEF DESCRIPTION OF DRAWINGS

The accompanying drawings described herein are used to provide an understanding of the present disclosure and constitute a part of the present disclosure. The illustrative embodiments of the present disclosure and descriptions thereof are used to explain the present disclosure, and do not constitute any improper limitation on the present disclosure.

REFERENCE SIGNS

100: housing, 110: middle frame, 111: sound collecting hole, 200: microphone;
300: vibration plate, 400: sound guide support, 410: sound guide groove, 420: mounting groove, 500: circuit board, 510: connecting hole:
600: mounting bracket, 610: mounting hole;
700: sealing member, 800: sound film, 900: screen assembly, A: first cavity, A1: sound guide channel, A2: second cavity.

DESCRIPTION OF EMBODIMENTS

To make the objectives, technical solutions, and advantages of the present disclosure clearer, the following clearly describes the technical solutions of the present disclosure with reference to embodiments of the present disclosure and the accompanying drawings. Apparently, the described embodiments are merely some rather than all of the embodiments of the present disclosure. All other embodiments obtained by a person of ordinary skill in the art based on the embodiments of the present disclosure shall fall within the protection scope of the present disclosure.

The following describes in detail the technical solutions disclosed in the embodiments of the present disclosure with reference to the accompanying drawings.

Figure 1:
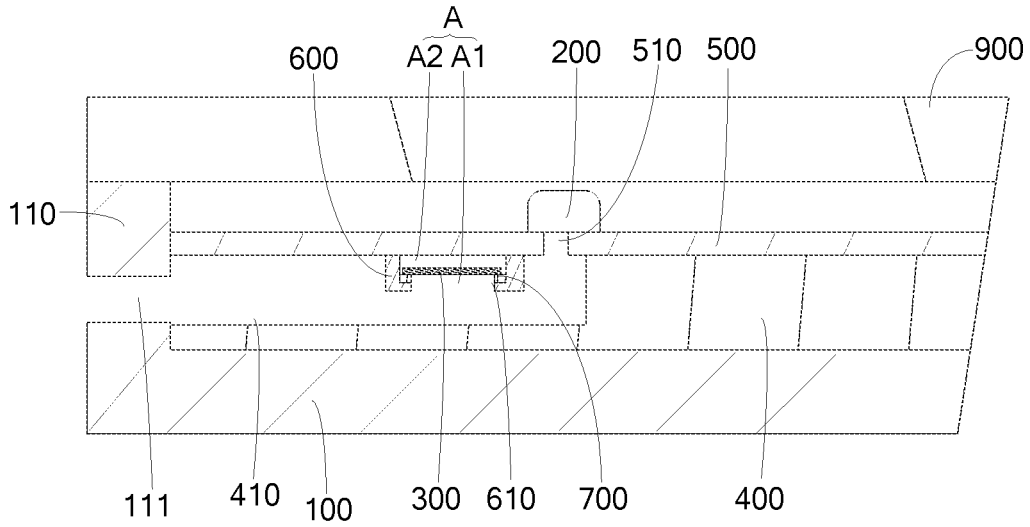
FIG. 1 is a cutaway drawing of a partial structure of a terminal device disclosed in some embodiments of the present disclosure.
Figure 2:
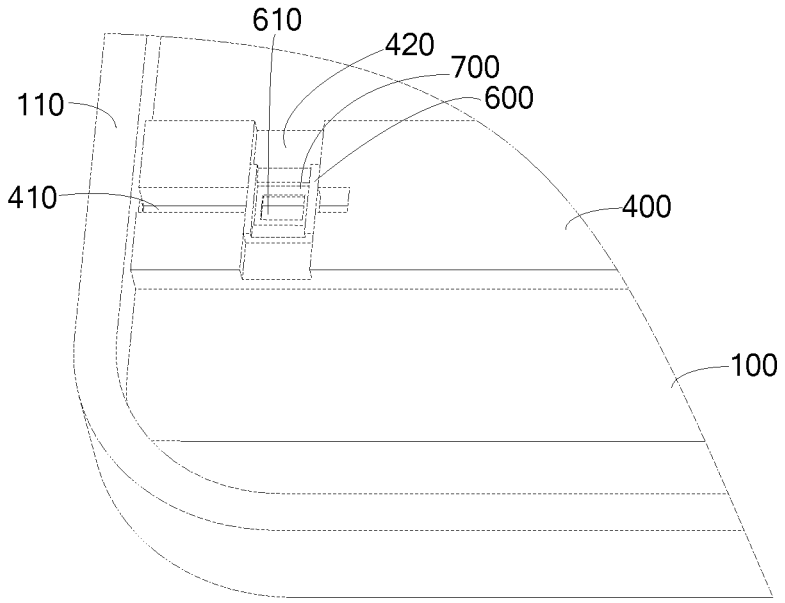
FIG. 2 is a solid figure of a partial structure of a terminal device disclosed in some embodiments of the present disclosure.
Figure 3:
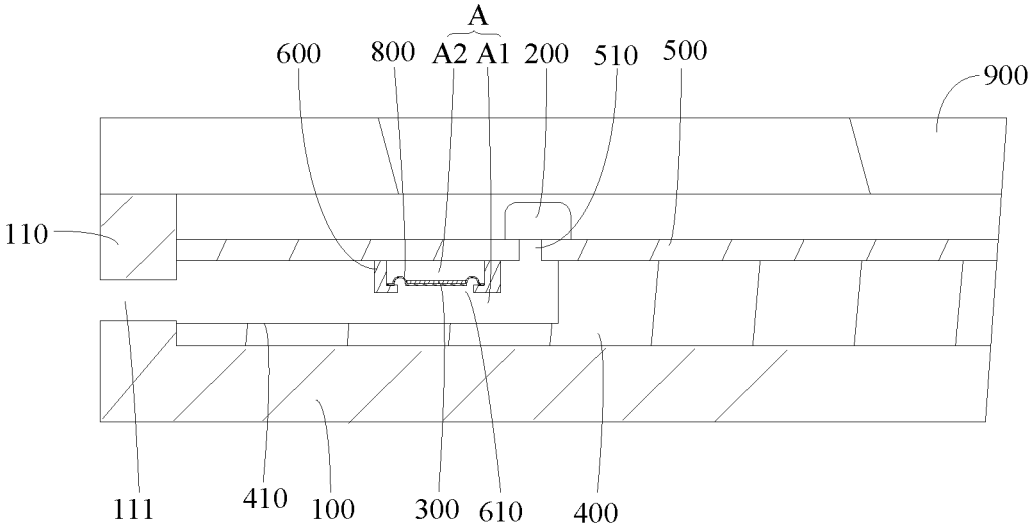
FIG. 3 is another cutaway drawing of a partial structure of a terminal device disclosed in some embodiments of the present disclosure.

Refer to FIG. 1 to FIG. 3. Some embodiments of the present disclosure disclose a terminal device. The disclosed terminal device includes a housing 100, a microphone 200, a sound guide support 400, a circuit board 500, and a vibration assembly.

The housing 100 is a basic component of the terminal device, and the housing 100 can provide an installation foundation for other components of the terminal device. In some embodiments of the present disclosure, the housing 100 is provided with a sound collecting hole 111, which is used by the microphone 200 to collect sound. The sound collecting hole 111 may be disposed on a plurality of positions of the housing 100. Usually, the housing 100 includes a middle frame 110, and the sound collecting hole 111 may be disposed in the middle frame 110. Certainly, the sound collecting hole 111 may alternatively be disposed on another position of the housing 100. In some embodiments of the present disclosure, a position for arrangement of the sound collecting hole 111 is not limited.

The sound guide support 400 and the circuit board 500 are both disposed in the housing 100. For example, the sound guide support 400 and the circuit board 500 may usually be fixed in the housing 100. The sound guide support 400 cooperates with the circuit board 500 to form a first cavity.

The vibration assembly is disposed between the sound guide support 400 and the circuit board 500. The vibration assembly can separate the first cavity A formed by the sound guide support 400 and the circuit board 500 into a sound guide channel A1 and a second cavity A2. The microphone 200 is a sound collecting component of the terminal device. The microphone 200 is disposed in the housing 100. In some embodiments of the present disclosure, the microphone 200 and the sound collecting hole 111 are respectively disposed at both ends of the sound guide channel A1. In a working process, sound in an environment of the terminal device can pass through the sound collecting hole 111 and the sound guiding channel A1, and is finally transmitted to the microphone 200, so as to implement sound collecting of the microphone 200.

According to the terminal device disclosed in some embodiments of the present disclosure, the first cavity A is formed between the sound guide support 400 and the circuit board 500, and the vibration assembly can separate the first cavity A into the sound guide channel A1 and the second cavity A2, so that the sound guide channel A1 and the second cavity A2 form a parallel resonant structure. The parallel resonant structure can form notch filtering at a resonant peak of the sound guide channel A1, thereby achieving suppression of the resonant peak. It can be learned that the terminal device disclosed in some embodiments of the present disclosure can solve a problem that relatively poor recording quality caused because a resonance peak cannot be suppressed when a speaker of the terminal device operates.

In an optional scheme, an inner wall of the sound guide channel A1 can be provided with a surface coating, and the surface coating can play a role in loss of excessively high frequency when the sound guide channel A1 resonates. It can be learned from the foregoing description that the terminal device disclosed in some embodiments of the present disclosure can achieve a more balanced microphone frequency response curve and relatively high recording sound quality, and avoid problems of noise, distortion, and the like caused because a resonance peak when the microphone 200 is recording is excessively high and consequently exceeds a threshold of an ADC.

As described above, the sound guide support 400 cooperates with the circuit board 500 to form the first cavity A. There may be a plurality of types of structures of the sound guide support 400. In an optional scheme, the sound guide support 400 may be provided with a sound guide groove 410, and the circuit board 500 covers a notch of the sound guide groove 410. The circuit board 500 and the sound guide groove 410 are connected to form the first cavity A. In the foregoing scheme, the structure is relatively simple, and a manner of forming the first cavity A is relatively easy to implement.

To facilitate electrical connection and sound collecting of the microphone 200, the microphone 200 is usually disposed on a side, away from the sound guide support 400, of the circuit board 500. The housing 100 is provided with a screen assembly 900, and the microphone 200 is usually located on an inner side of the screen assembly 900. For example, the microphone 200 may be fixed through conductive adhesive or soldering on the side, away from the sound guide support 400, of the circuit board 500, so that the circuit board 500 implements power supply. In this case, the circuit board 500 may be provided with a connecting hole 510, and the microphone 200 communicates with the sound guide channel through the connecting hole 510, so as to ensure normal operation of sound collection.

As described above, the vibration assembly is disposed between the sound guide support 400 and the circuit board 500, and there are a plurality of manners of mounting the vibration assembly. Refer to FIG. 1 and FIG. 2. The sound guide support 400 may further have a mounting groove 420, the mounting groove 420 intersects the sound guide groove 410, the vibration assembly includes a mounting bracket 600 and a vibration plate 300, and the mounting bracket 600 is disposed in the mounting groove 420. A portion of the mounting bracket 600 extends into the sound guide groove 410 through the notch of the sound guide groove 410, the portion of the mounting bracket 600 extending into the sound guide groove 410 may be provided with a mounting hole 610, the mounting hole 610 communicates with the sound guide groove 410, and the vibration plate 300 blocks the mounting hole 610. The vibration plate 300, the mounting bracket 600, and the circuit board 500 seal the notch of the sound guide groove 410, and together with the sound guide groove 410, form the sound guide channel A1. The circuit board 500, the mounting bracket 600, and the vibration plate 300 form the second cavity A2. The parts are assembled in the foregoing manner, so that the sound guide channel A1 and the second cavity A2 can be formed more conveniently.

In an optional scheme, the mounting bracket 600 may be a groove-shaped structural member, the groove-shaped structural member may be mounted in the mounting groove 420, the mounting groove penetrates the sound guide support, and both ends of the mounting groove 420 may be open ends extending to edges of the sound guide support 400. The groove-shaped structural member may be disposed between the circuit board 500 and the sound guide support 400, and an area, opposite to the sound guide groove 410, in the groove-shaped structural member may be provided with the mounting hole 610. In this case, the mounting bracket 600 using the groove-shaped structural member facilitates forming the second cavity A2, and the mounting groove 420 of the groove-shaped structural member is a through structure so that a vibration process of the vibrating assembly is vibration without being interfered with by air pressure.

In order to facilitate disassembly and assembly, in an optional scheme, the mounting bracket 600 may be fixed in the mounting groove 420 in a snap-fit manner. Certainly, the mounting bracket 600 can alternatively be fixed in the mounting groove 420 through a connecting member (for example, a threaded connecting member).

There are a plurality of manners of cooperation between the vibration plate 300 and the mounting hole 610. In an optional scheme, the vibration plate 300 may be fixed in a lap joint manner on an edge of the mounting hole 610. Such a lap joint assembly manner is easier to assemble. In order to ensure tightness of the sound guide channel A1, in an optional scheme, a sealing member 700 may be disposed between the vibration plate 300 and the edge of the mounting hole 610. The sealing member 700 can play a role of sealing and avoid a problem that the vibration plate 300 is not tightly sealed.

There may be a plurality of types of structures of the sealing member 700. In an optional scheme, the sealing member 700 may include a sealing tape and foam, and the vibration plate 300 blocks the mounting hole 610 through the sealing tape and the foam. The foam can support the vibration plate 300 for up and down vibrations. For example, the sealing tape and the foam may be bonded and fixed, and finally the vibration plate 300 is bonded to the edge of the mounting hole 610.

Certainly, the vibration plate 300 may alternatively be mounted in another way. Refer to FIG. 3. In an optional scheme, an area of the vibration plate 300 may be smaller than an area of the mounting hole 610, and the vibration plate 300 is covered with a sound film 800. The vibration plate 300 may be fixed on the mounting bracket 600 through the sound film 800, and an entirety formed by the vibration plate 300 and the sound film 800 blocks the mounting hole 610. In this case, the vibration plate 300 is more similar to a mass block, so that the entirety formed by the vibration plate 300 and the sound film 800 has an obvious vibration effect, achieving a better resonance peak suppression effect.

In an optional scheme, a sound absorbing structural member such as soundproofing cotton may be disposed in the sound guide channel A1. Arranging soundproofing cotton in the sound guide channel A1 can increase acoustic resistance of the sound guide channel A1, so as to reduce a resonance peak of the sound guide channel A1, so that the microphone 200 has a relatively flat response curve, and finally suppression of the resonance peak can be achieved, thereby enhancing a sound collection effect. In addition, the sound film 800 can ensure compliance of vibration.

Optionally, the sound absorbing structural member may be the vibration assembly including the vibration plate 300 and the mounting bracket 600.

The terminal device disclosed in some embodiments of the present disclosure may be a terminal device such as a mobile phone, a tablet computer, an ebook reader, a game console, a wearable device (such as a smart watch). In some embodiments of the present disclosure, a type of the terminal device is not limited.

The foregoing embodiments of the present disclosure focus on differences between various embodiments. Different optimization features of the various embodiments can be combined to form a better embodiment as long as they are not contradictory. Considering conciseness of description, details are not described herein.

The foregoing descriptions are merely embodiments of the present disclosure, but are not intended to limit the present disclosure. For a person skilled in the art, various modifications and changes may be made to the present disclosure. Any modification, equivalent replacement, or improvement made without departing from the spirit and principle of the present disclosure shall fall within the scope of the claims of the present disclosure.

What is claimed is:

1. A terminal device, comprising a housing, a microphone, a sound guide support, a circuit board, and a vibration assembly, wherein the housing is provided with a sound collecting hole, the sound guide support and the circuit board are disposed in the housing, the sound guide support and the circuit board form a first cavity, the vibration assembly is disposed between the sound guide support and the circuit board and separates the first cavity into a sound guide channel and a second cavity, and the microphone and the sound collecting hole are respectively disposed at both ends of the sound guide channel.

2. The terminal device according to claim 1, wherein the sound guide support is provided with a sound guide groove, the circuit board covers a notch of the sound guide groove, the circuit board and the sound guide groove are connected to form the first cavity, the circuit board is provided with a connecting hole, and the microphone is disposed on a side, away from the sound guide support, of the circuit board, and communicates with the sound guide channel through the connecting hole.

3. The terminal device according to claim 2, wherein the sound guide support further comprises a mounting groove, the mounting groove intersects the sound guide groove, the vibration assembly comprises a mounting bracket and a vibration plate, the mounting bracket is disposed in the mounting groove, a portion of the mounting bracket extends into the sound guide groove through the notch of the sound guide groove, the portion of the mounting bracket extending into the sound guide groove is provided with a mounting hole, the mounting hole communicates with the sound guide groove, the vibration plate blocks the mounting hole, and the vibration plate, the mounting bracket, and the circuit board seal the notch of the sound guide groove, and together with the sound guide groove, form the sound guide channel.

4. The terminal device according to claim 3, wherein the mounting bracket is a groove-shaped structural member, the groove-shaped structural member is mounted in the mounting groove, the mounting groove penetrates to edges of the sound guide support, both ends of the mounting groove are open ends, the groove-shaped structural member is disposed between the circuit board and the sound guide support, and an area, opposite to the sound guide groove, in the groove-shaped structural member is provided with the mounting hole.

5. The terminal device according to claim 4, wherein the mounting bracket is fixed in the mounting groove in a snap-fit manner.

6. The terminal device according to claim 3, wherein the vibration plate is fixed in a lap joint manner on an edge of the mounting hole.

7. The terminal device according to claim 6, wherein a sealing member is disposed between the vibration plate and the edge of the mounting hole.

8. The terminal device according to claim 7, wherein the sealing member comprises a sealing tape and foam, and the vibration plate blocks the mounting hole through the sealing tape and the foam.

9. The terminal device according to claim 3, wherein an area of the vibration plate is smaller than an area of the mounting hole, the vibration plate is covered with a sound film, the vibration plate is fixed on the mounting bracket through the sound film, and an entirety formed by the vibration plate and the sound film blocks the mounting hole.

10. The terminal device according to claim 1, wherein the housing comprises a middle frame, and the sound collecting hole is disposed in the middle frame.

11. The terminal device according to claim 1, wherein a sound absorbing structural member is disposed in the sound guide channel.

* * * * *